United States Patent [19]

Bradshaw

[11] 4,263,734

[45] Apr. 28, 1981

[54] METHOD OF MAKING A CERAMIC ARTICLE AND ARTICLE OF MANUFACTURE

[76] Inventor: Vincent L. Bradshaw, 839 Eighth St., Wyandotte, Mich. 48192

[21] Appl. No.: 71,652

[22] Filed: Aug. 31, 1979

[51] Int. Cl.[3] ..... G09F 3/00; A47G 1/12; B44C 1/26

[52] U.S. Cl. ..... 40/324; 428/13; 428/63; 428/67; 215/1 R; 215/100 R; D7/6; D7/9; 156/89; 156/293; 264/62; 264/246; 264/267

[58] Field of Search ..... 428/13, 67, 63; 40/324; 215/1 R, 100 R; D7/6, 9; 156/89, 293; 264/62, 246, 267

[56] References Cited

U.S. PATENT DOCUMENTS

| | | | |
|---|---|---|---|
| 1,246,080 | 11/1917 | Frank | 250/465 |
| 1,536,716 | 5/1925 | Kade | 40/10 D |
| 1,600,658 | 9/1926 | Weil | 40/324 |
| 1,622,775 | 3/1927 | Fink | 428/67 |
| 1,744,328 | 1/1930 | Morley | 215/1 R |
| 1,950,230 | 3/1934 | Donaldson | 428/67 |
| 2,186,940 | 1/1940 | Sullivan | 220/265 |
| 2,313,688 | 3/1943 | Wappner et al. | 73/374 |
| 2,350,421 | 6/1944 | Schoder et al. | 428/13 |
| 2,577,030 | 12/1951 | Neumann | 215/100 R |
| 2,586,978 | 2/1952 | Murray | 428/67 |
| 2,704,211 | 3/1955 | Decepoli | 428/13 |
| 2,984,035 | 5/1961 | Nalle, Jr. | 40/324 |
| 3,082,556 | 3/1963 | Schwartz et al. | 40/2 E |
| 3,514,887 | 6/1970 | Jacob | 40/324 |
| 4,044,889 | 8/1977 | Orentreich et al. | 220/82 A |

*Primary Examiner*—William R. Dixon, Jr.
*Attorney, Agent, or Firm*—Cullen, Sloman, Cantor, Grauer, Scott & Rutherford

[57] ABSTRACT

The method of making a ceramic article which includes forming the object in a mold, removing the object, drying, sanding and baking; the improvement which comprises the intermediate steps before drying the molded object of carving out a recessed area in the exterior of the object wall and further carving an undercut groove in the wall peripherally communicating with the recessed area throughout 360 degrees. Further steps after baking the molded object include cementing a sheet having a picture, ornament or design thereon to the wall of the object within the recessed area and filling the recessed area and undercut groove with a transparent self-drying resin. A modified method of ornamenting an object having a recessed area and undercut communicating peripheral groove formed in the wall thereof which comprises the steps of cementing a sheet having a picture, ornament or design to the wall of the molded object within the recessed area and filling the recessed area and undercut groove with a transparent self-drying resin. In a molded article of manufacture having a wall, there being a recessed area in the exterior of the wall and a continuous undercut groove communicating with the recessed area throughout 360 degrees. A sheet having a picture, ornament or design thereon is secured upon said wall within the recessed area. A transparent lense of plastic material is snugly nested and molded into said recessed area and groove to sealingly overlie the sheet and secured within said recessed area and groove.

11 Claims, 8 Drawing Figures

METHOD OF MAKING A CERAMIC ARTICLE AND ARTICLE OF MANUFACTURE

BACKGROUND OF THE INVENTION

Ceramic methods are known in the art by which a mold is filled with a mud solution, and after a period of time usually less than an hour the solution is removed leaving a ceramic object. After hardening of the object it is removed from the mold and any rough edges are cleaned. The object is completely dried and sanded smooth and thereafter baked in a kiln for hardeness. Selectively the article may be painted as desired and again baked in a kiln for finishing.

Heretofore articles have been molded or otherwise formed with apertures to receive ornamentation upon the wall thereof, and various mechanical means have been employed for securing the ornament to the article. Examples of such prior art efforts are found in the following U.S. Pat. Nos.:

1,246,080;
1,744,328;
2,577,030;
3,082,556;
1,950,230;
4,044,889;
1,536,716;
2,186,940;
2,586,978;
1,622,775;
2,350,421;
2,313,688.

SUMMARY OF THE INVENTION

It is an object of the present invention to provide in conjunction with said pre-existing method of making ceramic objects the improvement which comprises the intermediate steps before drying the molded article of carving out a recessed area in the exterior wall of the article, the further carving an undercut groove in the object wall peripherally communicating with the recessed are throughout 360 degrees. Further steps after baking the molded article include cementing a sheet having a picture, ornament or design thereon to the wall of the article within the recessed area and filling the recessed area and undercut groove with a transparent self-drying resin for sealing and retaining the picture within the recessed area, the resin forming a permanent window interlocked with the object wall.

It is a further object to provide the molded article in the form of a cup. It is another object to provide an intermediate step before hardening the molded object of applying to the interior of the object wall opposite from the recessed area a layer of mud solution for thickening said wall adjacent the recessed area. It is another object to provide an additional step before carving the recessed area of cutting a flat side upon the exterior of the wall to accomodate the recessed area.

It is another object to provide a method of ornamenting a molded object which has a recessed area and an undercut communicating peripheral groove formed in the wall thereof which comprises the steps of cementing a sheet having a picture, ornament or design to the wall of the object within the recessed area and filling the recessed area and undercut groove with a transparent self-drying resin for sealing and retaining the picture within said recessed area.

It is a further object to provide a molded article of manufacture having a wall there being a recessed area of predetermined shape in the exterior of the article wall and a continuous undercut groove in the wall communicating with the recessed area throughout 360 degrees. A sheet having a picture, ornament or design thereon is secured upon the wall within the recessed area and a transparent lense of plastic material is snugly nested and molded into said recessed area and groove sealingly overlying the sheet and secured within said area and groove. The molded article may be a cup or a glass or other container or a wall ornament or plaque.

These and other objects will be seen from the following specification and claims in conjunction with the appended drawings.

THE DRAWINGS

It will be understood that the above drawings illustrate the preferred embodiment and modifications thereof in accordance with the various steps of the present method and that other embodiments are contemplated as to the article of manufacture and method within the scope of the claims hereafter set forth.

DETAILED DESCRIPTION OF AN ILLUSTRATIVE EMBODIMENT OF THE PRESENT ARTICLE OF MANUFACTURE AND METHOD

Figure 1:
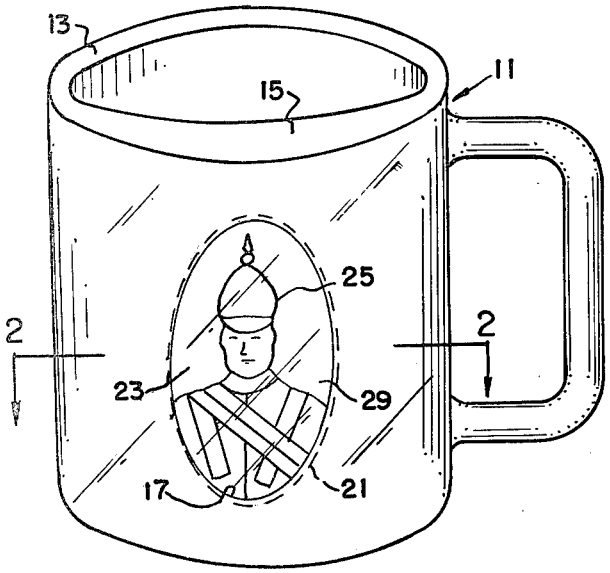
FIG. 1 is a front perspective view of a ceramic cup ornamented in accordance with the present method.

The present invention is directed to a method of making a ceramic object and the article of manufacture such as a ceramic cup 11, FIG. 1, made in accordance with said method.

Figure 2:
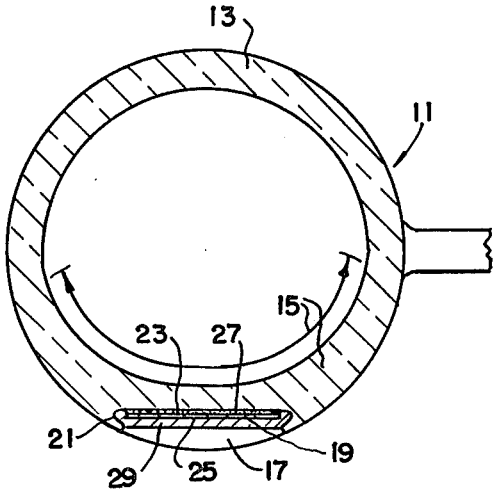
FIG. 2 is a section taken in the direction of arrows 2—2 of FIG. 1.

In the drawing FIGS. 1 and 2 a ceramic cup has a peripheral wall 13 which in this embodiment has a thickened wall portion 15 upon one side to the extent designated by the arrows 15 in FIG. 2. Co-extensive with the thickened wall portion there is formed within the wall of the cup a recessed area 17 which may have a flat bottom wall as shown at 19 and which is bounded by peripheral undercut groove 21 which extends throughout 360 degrees with respect to the recessed area.

A sheet or strip 23 having thereon a picture, an ornament or a design as at 25 is cut and shaped so as to fit within the recessed area and is secured thereto by a suitable cement 27.

A transparent lense or window 29 of a plastic material is snugly nested and molded into the recessed area and groove and is adapted to sealingly overlie the sheet 23 and is secured and retained within the recessed area and undercut groove.

The ornamented cup may be made in accordance with the hand process wherein a two part porous mold as a first conventional step is filled with a mud solution and is permitted to stand for a period of time, such as forty minutes, for illustration.

A second conventional step is to dump the solution out leaving a ceramic object within the mold. This is caused by the action of the water portion of the mud solution passing through the pores of the mold and with the remaining solids leaving an unfinished ceramic object with the mold.

A third conventional step is to let the object harden within the mold for a period of approximately four hours for illustration.

A fourth conventional step is the removal of the object from the mold, the cleaning up of the rough edges.

A further conventional step is to let the object dry completely and thereafter sand the surfaces to render them smooth.

A further step in the conventional method of making ceramic objects is to then bake the object in a kiln for the desired hardness. A further step is to paint the object as desired.

Another conventional step is to again bake in a kiln finishing the painted object and thereafter permitting the object to cool.

It is with this background with which the present intermediate method steps are involved.

The present method therefore includes the following intermediate steps before the above described drying of the molded object of, namely:

1. Carving out a recessed area 17 within the exterior of the object wall 13 of a predetermined desired shape such as shown in FIG. 1.

2. Carving an undercut continuous groove 21 in the wall of the object peripherally communicating with the recessed area throughout 360 degrees, FIG. 1.

These intermediate steps are followed by the conventional drying of the object and sanding the surface and the baking in a kiln for hardness, etc. At this stage there has been provided a ceramic object such as the cup 11 which has formed therein recessed area 17 having a bottom wall 19 and adjacent the recessed area a continuous undercut groove 21 which communicates with the recessed area throughout 360 degrees.

A further step in the process of ornamenting the cup includes after the baking of the molded article the following additional steps:

3. Taking a strip of paper or other material 23 to which there has been applied a picture, ornament or design such as at 25, and cutting the same so as to fit within the recessed area 17 and thereafter applying a glue, adhesive or cement to the back surface of the strip or sheet 23 and firmly applying said picture upon the bottom wall 19 of the recessed area. This will now hold the picture or design or ornament in position within the object such as the present cup 11.

A final step in the present process includes:

4. Filling the recessed area 17 and the undercut groove 21 with a transparent self-drying resin for sealing and retaining the picture within the recessed area, the resin forming a permanent window or lense 29 which is completely nested within the recessed area and undercut groove and interlocked with the object wall 13, or the thickened portion of the wall as shown at 15 in FIGS. 1 and 2.

Transparent self-drying resin is a plastic material and is referred to as a resin laminate and may be purchased on the market. It is identified in one instance as Build 50, a Decopauge and Super Laminate manufactured by Behr Process Corporation, Santa Ann, California 92702. This product contains two ingredients at least one of which is liquid referred to as formula A and formula B which are separated until actual application to an object. In the use of such laminate two parts of formula A are mixed with one part of formula B and the mixture stirred until clear. The mixture is then flowed into the recessed area and into the continuous peripheral undercut groove 21 until all portions thereof have been filed, completely covering the sheet 23 having a picture, ornament or other design thereon. In the use of the laminate it is allowed to dry within a period of five to seven hours and become hard within approximately twelve hours. One method of applying the resin to the recessed area and peripheral groove is shown for illustration in FIGS. 6, 7 and 8.

The novel method steps incorporated into a pre-existing method for making a ceramic object is productive of an article of manufacture such as a ceramic cup, container, a flower pot or for that matter a wall plaque.

In all of these situations the conventional method steps of making such object include the intermediate novel method steps above described which include for the particular object the carving out of the recessed area in the exterior of the object wall, thereafter carving an undercut groove in the object wall peripherally communicating with the recessed area throughout 360 degrees. These two steps occur before the drying of the molded object. Additional steps following the baking of the molded article in accordance with the heretofore known conventional process includes the additional novel steps of cementing a picture, ornament or design to the wall of the molded object within the recessed area and thereafter filling the recessed area and undercut adjacent groove with a transparent self-drying resin or other plastic material for sealing and retaining the picture within the recessed area and wherein the resin or other plastic when dried and hardened forms a permanent window overlying the ornament and interlocked with the object wall.

MODIFIED METHOD

A modification of the above method includes an intermediate step before hardening the molded object which includes applying to the interior of the object wall adjacent but opposite from the area to be recessed an additional layer of mud solution for thickening said wall adjacent the recessed area as at 15, FIGS. 1 and 2. This step is interposed after the remaining solution has been dumped from the ceramic object at the beginning. Thereafter the mold is laid on the side which is desired for the recessed area 17 and the partially filled with mud solution in order to build up the thickness of that wall as at 15, FIGS. 1 and 2.

The other steps follow, namely, hardening of the molded object, however, the step involving the carving out of the recessed area and the carving out of the peripheral groove contemplates that this is done in the exterior surface of the cup wall where it has been thickened as at 15. This wall thickening thus compensates for the material of the object which has been removed in the forming of the recessed area and undercut groove.

MODIFICATION OF THE PRESENT METHOD

Figure 3:
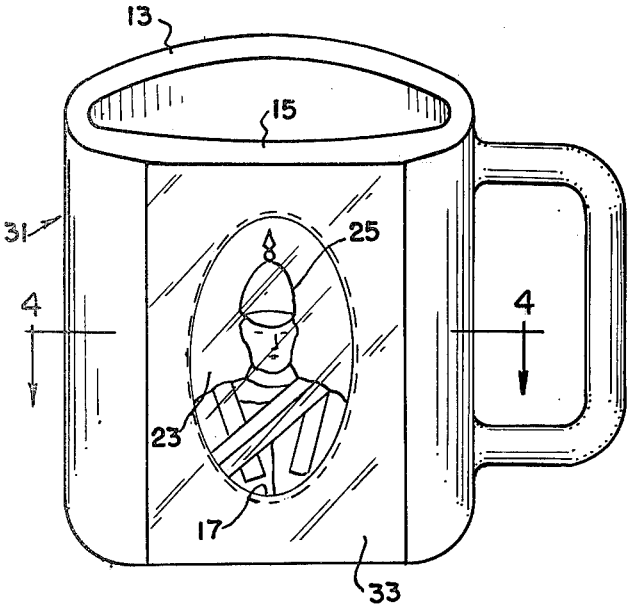
FIG. 3 is a front perspective view of a modified ceramic cup ornamented in accordance with the present method.
Figure 4:
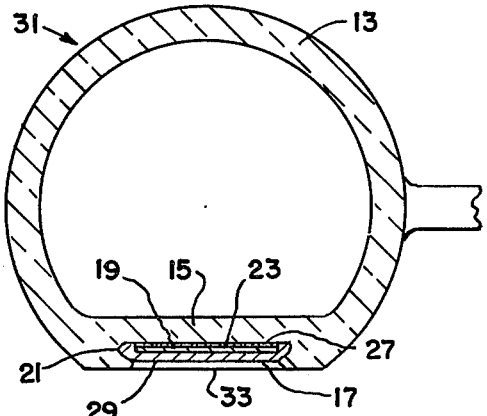
FIG. 4 is a section taken in the direction of arrows 4—4 of FIG. 3.

A further modified method is described with respect to FIGS. 3 and 4 of the drawing and wherein the ceramic object or cup 31 has cut upon the exterior thereof a flattened wall 33. This intermediate step occurs before the carving of the recessed area in the molded object. Accordingly, the recessed area 17, FIGS. 3 and 4 is formed within the falttened wall 33. Accordingly, the recessed area and undercut groove are entirely within the flattened wall portion 33. The present method also contemplates for the article of manufacture as well as for the above method the intermediate step of thickening of the object wall as at 15 for a build up thereof to compensate for the material removed therefrom by the exterior flattened wall portion 33 as well as the recessed area formed therein.

Figure 5:
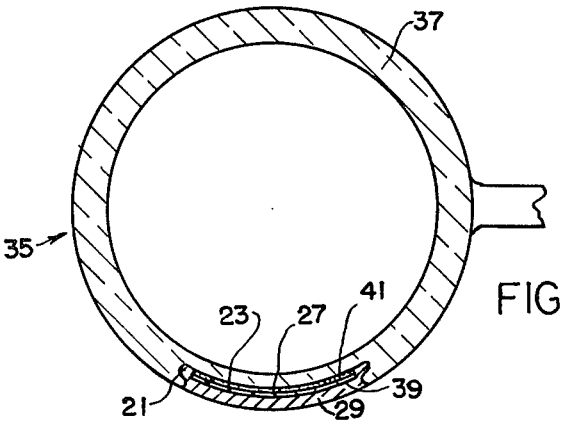
FIG. 5 is a plan view of a glass ornamented in accordance with a modification of the present method.

The recessed area may have a flat bottom wall as shown at 19, FIGS. 2 and 4, or the bottom wall of the recessed area could be arcuate as shown at 41 in the modification of FIG. 5.

In the illustrative embodiment and in the formation of the lense or window 29, FIGS. 2 and 4, such lense or window is of substantially uniform thickness throughout.

In the embodiment shown in FIG. 5 the bottom wall of the recessed area is arcuate as at 41 and the transparent plastic lense or window 29, FIG. 5, has been formed within the boundry of the object 35 and is again substantially uniform in thickness.

MODIFIED METHOD OF ORNAMENTING A MOLDED OBJECT

There may be provided a molded object which has been already formed with its side wall 13 which may be thickened as at 15 and which will have already molded or formed therein a recessed area 17 and surrounding said recessed area and in communication therewith continuous undercut groove 21 which extends throughout 360 degrees.

The novel step of the present modified method includes taking this preformed object which may be ceramic, or a glass 35 or other object as shown in FIG. 5, cutting a sheet containing a picture, ornament or design to the appropriate shape for the recessed area already therein and adhering such picture within the recessed area using a suitable glue or cement or other adhesive. The secondary step includes the filling of such recessed area and undercut groove with the present transparent self-drying plastic or resin for sealing and retaining the picture within the recessed area and wherein the resin forms a permanent window or lense 29 which is interlocked with the object wall as in FIGS. 4 and 5.

Accordingly a finished or molded or formed object may be provided which already has therein the recessed area within the contour of the object and a communicating undercut groove throughout 360 degrees which object could be a cup, a glass, an open top container or a wall plaque.

The present invention in addition to the method steps heretofore set forth and the modifications thereof includes a final molded article of manufacture such as shown at 11 in FIGS. 1 and 2 and 31 as shown in FIGS. 3 and 4.

In the present method and in the article of manufacture above described the lense or window once set and hardened is substantially permanently retained within the recessed area and within the outer periphery of the object and is not only interlocked with the object or cup but is laminated onto the picture or other design which has been adhered to the bottom wall of the recessed area.

MODIFIED METHOD AND ARTICLE OF MANUFACTURE

The molded object may be glass 35 or other glass article which has a peripheral wall 37 and within the exterior surface of a portion thereof the recessed area 39 whose bottom wall 41 is arcuate and into which has been applied and affixed by cement or other adhesive a strip containing a picture or other ornament as at 23–25, FIG. 1. Into the recessed area of the glass object there is poured the present self-drying plastic lense or window shown at 29, FIG. 5, which fills the entire recessed area as well as the undercut peripheral groove 21 throughout 360 degrees.

Figure 6:
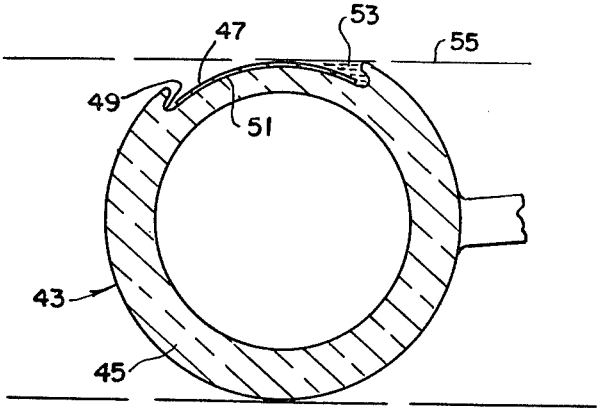
FIGS. 6, 7 and 8 are schematic plan views illustrating the progressive application of a series of resin laminates into the recessed area and undercut groove of a molded object.
Figure 7:
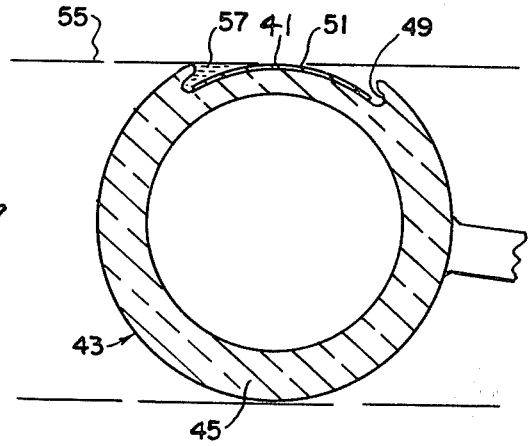
Figure 8:
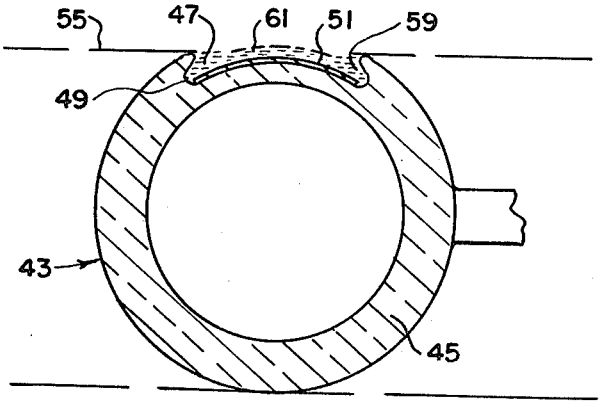

Referring to FIGS. 6, 7 and 8 there is illustrated the manner by which the plastic laminate as described is applied to the recessed area 47 and wherein the bottom wall thereof at 41 is arcuate. In this case laminate is applied in three steps such as shown, FIGS. 6, 7 and 8.

Referring to FIGS. 6, 7 and 8 one method of application of the plastic or resin laminate is shown and wherein FIG. 6 the molded object such as a cup or glass 43 has continuous wall 45 and a recessed area 47 therein and communicating therewith a continuous undercut groove 49 which extends around the recessed area throughout 360 degrees. A picture or other strip having an ornament or design is shown at 51 and is applied as in FIG. 8 to the bottom surface of the recessed area 47. Initially as in FIG. 6 there is a first application of the laminate plastic resin material as at 53 with the article or cup lying upon its side and inclined downwardly from the horizontal dash line 55. A first application of resin laminate is applied as at 53 to the lower-most portions of the recessed area and undercut groove. After a sufficient drying period the article 43 is rotated upon its supporting surface in the opposite direction, FIG. 7, with respect to the dash line 55 showing the level and a second application of resin laminate is applied as at 57 to that portion of the recessed area 47. After a sufficient drying period, the object is moved to an intermediate position upon a support and with respect to the dash level line 55 FIG. 8 and a third application of resin laminate is applied at 59 for completely filling the recessed area 47 and the undercut peripheral groove 49. The finished window or lense is designated a 61 overlying and retaining the picture 51 or other strip as initially adhered to the base of the recessed area. Accordingly, the window or plastic transparent lense 61 is within the general contour of the object such as the glass 43.

In the illustration shown in FIGS. 6, 7 and 8 bottom wall 41 defining the recessed area 47 is arcuate.

Accordingly the present method and article of manufacture contemplates that the formed or molded object may be of glass as shown at 35, FIG. 5 which has more strength than the ceramic objects above described with respect to FIGS. 1 through 4. Having described my invention reference should now be had to the following claims.

I claim:

1. In a molded ceramic container having an exterior wall;

there being a recessed area of predetermined shape in the exterior of the container wall, and a continuous undercut groove in said wall communicating with the recessed area throughout 360 degrees;

a flat sheet having a picture, ornament or design thereon secured upon said wall within the recessed area;

and a transparent lense of plastic material snugly nested and molded into said recessed area and groove sealingly overlying the sheet and secured within said area and groove, said lense being initially poured in liquid form into said recessed area and undercut groove.

2. In the molded container of claim 1, the securing of said lense being substantially permanent.

3. In the molded container of claim 1, the lense comprising a mixture of self-drying acrylic plastic ingredients flowed into said recessed area and groove throughout 360 degrees.

4. In the molded container of claim 3, said lense forming a laminate with said sheet.

5. In the molded container of claim 1, the article being a cup.

6. In the molded container of claim 1, said article having an exterior flattened wall portion; said recessed area being in registry with said flattened wall portion, whereby the lense is of uniform thickness throughout its area and flat.

7. In the molded container of claim 1, the recessed area having a flat bottom wall surface.

8. In the molded container of claim 1, the recessed area having a curved bottom wall surface.

9. In the molded container of claim 1, said lense being confined within the exterior contour of the molded article.

10. In the molded article of claim 1, the article being a glass.

11. In the molded article of claim 1, said container being formed in a mold and succesively dried and thereafter baked, the recessed area and peripheral groove being carved within the molded container before drying and baking thereof.

* * * * *